United States Patent [19]

Sie

[11] Patent Number: 4,493,430

[45] Date of Patent: Jan. 15, 1985

[54] FLOATING ROOF SEAL USING A COIL SPRING

[75] Inventor: Swan K. Sie, Middlesex, England

[73] Assignee: Chicago Bridge & Iron Company, Oak Brook, Ill.

[21] Appl. No.: 432,655

[22] Filed: Oct. 4, 1982

[51] Int. Cl.[3] ..... B65D 88/46

[52] U.S. Cl. ..... 220/224; 220/226

[58] Field of Search ..... 220/216–227; 277/164, 163

[56] References Cited

U.S. PATENT DOCUMENTS

| | | | |
|---|---|---|---|
| 572,883 | 12/1896 | Flynt | 277/164 |
| 2,695,550 | 11/1954 | Baxter, Jr. | 277/164 X |
| 2,855,122 | 10/1958 | Ulm et al. | 220/224 X |
| 2,960,252 | 11/1960 | Ulm | 220/224 |
| 3,136,444 | 6/1964 | Moyer | 220/226 |
| 3,185,335 | 5/1965 | Lecler | 220/222 |
| 3,291,496 | 12/1966 | Wilste | 277/164 |
| 3,307,733 | 3/1967 | DeBock | 220/226 |
| 3.445,120 | 5/1969 | Barr | 277/164 |
| 3,800,975 | 4/1974 | Nishkian et al. | 220/224 |
| 3,926,332 | 12/1975 | Okamoto | 220/226 |
| 4,004,708 | 1/1977 | Boyd | 220/224 |
| 4,154,359 | 5/1979 | Bissett | 220/224 X |

FOREIGN PATENT DOCUMENTS

| | | | |
|---|---|---|---|
| 337874 | 5/1904 | France | 277/164 |
| 11228 | of 1888 | United Kingdom | 277/164 |
| 17765 | of 1893 | United Kingdom | 277/164 |
| 443082 | 2/1936 | United Kingdom | 277/163 |

*Primary Examiner*—Stephen Marcus
*Assistant Examiner*—Robert Petrik
*Attorney, Agent, or Firm*—Marshall, O'Toole, Gerstein, Murray & Bicknell

[57] ABSTRACT

A resilient seal located in and spanning the vapor space between a tank wall and a floating roof wall with the seal including a vapor resistant flexible strip of material having parallel longitudinal edges attached to the roof defining a horizontal pouch extending around the roof periphery and a horizontal coil spring located in the pouch for the length of the vapor space.

3 Claims, 6 Drawing Figures

FIG. 1
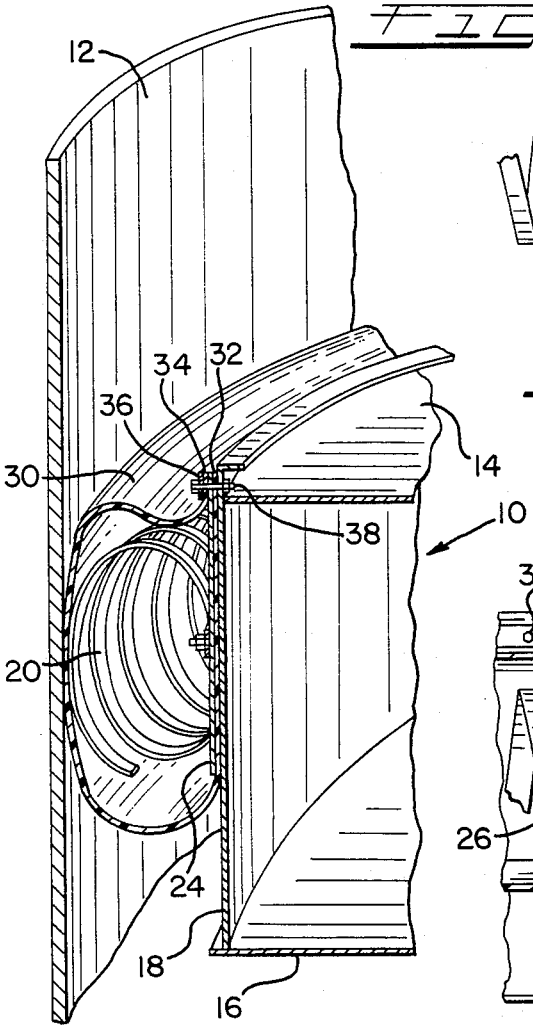
FIG. 3
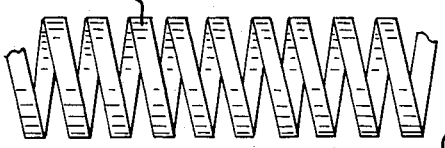
FIG. 5
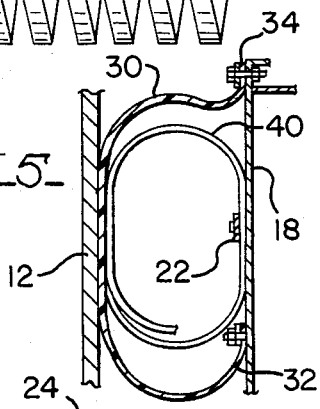
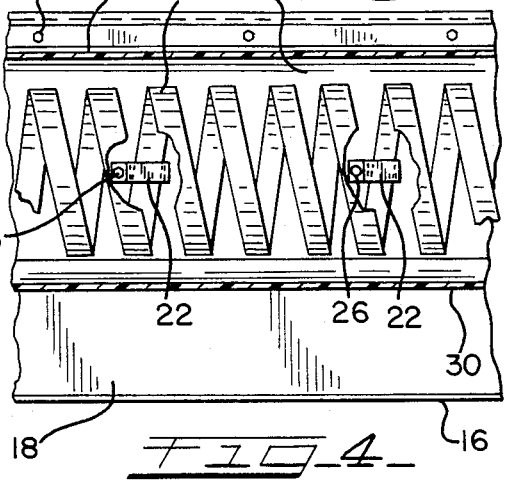
FIG. 4
FIG. 2
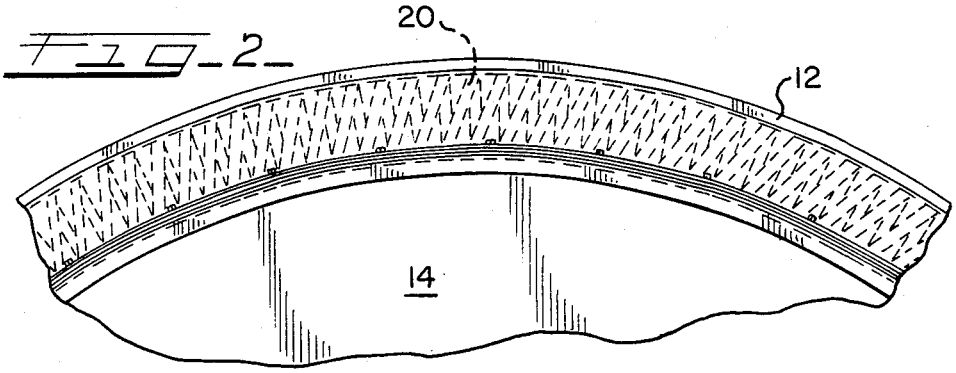

FLOATING ROOF SEAL USING A COIL SPRING

This invention relates to an improvement in floating roof tanks used for the storage of petroleum products or other volatile liquid materials, and in particular relates to an improved seal for a floating roof.

BACKGROUND OF THE INVENTION

In a conventional floating roof tank, with which the seal of the invention is particularly useful, there is provided a clearance space or rim space between the tank side wall and the vertical rim or wall of the roof. It is necessary to provide such clearance space to permit unrestrained vertical travel of the roof within the tank. The clearance space is of sufficient size that local dimensional variations in the circularity of the tank sidewall or shell, commonly called out-of-roundness, which can result from uneven foundation settlement, imprecise fabrication or erection or unusual live loads such as high winds and the like, do not hamper vertical travel of the roof.

A conventional system for centering a floating roof in a tank and simultaneously sealing the space between the roof rim and the tank inner side wall employs as a sealing means a yieldable annulus suspended by the roof and extending from contact with the roof rim into contact with the tank wall. The annulus can be made of flexible sheet material and can contain a fluid, i.e. liquid or gas, such as water or nitrogen, or a resilient material such as a polymeric foamed material. U.S. Pat. Nos. 3,136,444; 3,120,320; 3,075,668; 3,055,533; 2,973,113 and 2,968,420 illustrate seals of those types.

Other apparatus to maintain the roof centered in the tank and to effect a seal against evaporation loss uses a plurality of vertical shoes adapted to slidably contact the entire circular inner side wall of the tank and means supported by the roof for pressing the shoes against the inner side wall, as well as to support the shoes. Vapor loss between the roof and shoes is prevented by a flexible vapor resistant fabric barrier which extends from the upper part of the shoes to the floating roof top edge. Such apparatus is disclosed in many U.S. Pat. Nos. including 2,587,508; 2,630,937; 2,649,985 and 2,696,930.

Many floating roof storage tanks are erected at great distances and at places remote from manufacturing centers around the world. This makes it necessary to transport all the components at great cost because of the labor and shipping costs involved. Because of this, it is desirable if an improved vapor space seal not only seals properly but desirably also employs components which are low cost, readily shipped and transported, easily assembled and quickly installed.

Glass U.S. Pat. No. 1,674,038 discloses a floating roof storage tank which uses a plurality of tubular sections as a seal which bridges the space between the tank wall and the roof top edge. The tubular sections are not located between the roof wall and the tank wall so that they cannot exert a centering action on the roof. Instead, the tubular sections rest on a flange slanted upwardly and inwardly from the roof upper edge. The tubular sections, in one version, are inflated with air and internally weighted with gravel, shot or some other material, to wedge the tubular sections between the flange and the tank wall. FIG. 3 of the reference shows tubular sections with springs therein, with the springs stated to have the same effect in holding the tubes distended that air has.

SUMMARY OF THE INVENTION

According to a first aspect of the invention there is provided an improved vertical cylindrical liquid storage tank of imprecise circularity having a circular floating roof with an outer cylindrical vertical wall of smaller diameter than the tank thereby defining a vapor space between the roof wall and the tank wall, with the improvement comprising a resilient seal located in and spanning the entire vapor space between the tank wall and the roof wall; the seal including a vapor resistant flexible strip of material having parallel longitudinal edges attached to the roof defining a horizontal pouch extending around the roof periphery; and a horizontal coil spring located in the pouch for the length of the vapor space.

One edge of the strip can be connected near the top of the roof wall and the other edge can be connected to the roof wall below the first edge. Alternatively, the edges of the longitudinal strip can be brought together in adjoining contacting arrangement with the strip edges side-by-side and attached to the roof wall near the wall upper edge.

The coil spring can be circular in end view. If desired, the coil spring height can be greater than its width so that the spring is elliptical in end view thereby pushing a greater surface area of the strip into contact with the tank wall. Such an out-of-round shape prevents the spring from rolling if the coil is not anchored. In this regard, the coil spring can be formed with a straight side, such as in a D shape in lateral section, to prevent rolling. The straight side is desirably placed towards the roof side wall.

The coil spring can contact and be joined to the roof wall to hold it steady even though it is in the pouch. Spaced apart clips can be used to connect the coil spring to the roof wall.

Another way the spring is held steady is by suspending a vertical metal plate in the pouch with an upper edge of the plate located between the strip edges, with the coil spring connected to the outer surface of the metal plate, such as by clips, or a bar running through the spring and fastened to the plate.

The coil spring can be one piece i.e. the coil spring is unitary and integral for its entire length and the two ends are interengaged, or the coil spring can be made of discrete segments placed end-to-end and with adjacent ends interengaged.

According to another aspect of the invention, there is provided a method of producing an improved vapor seal for a vertical cylindrical liquid storage tank of imprecise circularity having a circular floating roof with an outer cylindrical vertical wall of smaller diameter than the tank thereby defining a vapor space between the roof wall and the tank wall which requires a vapor seal, comprising providing a shipment of metal bar stock at a site where a tank of the described type is being erected; forming the bar stock at the site into one or more coil segments slightly larger in width than the width of the vapor space; horizontally positioning the one or more coil segments in line, completely around the roof perimeter, in a pouch between the tank wall and the roof wall with said pouch being formed at the site from a vapor resistant flexible strip of material having parallel longitudinal edges; and attaching the strip edges to the roof completely around the roof perimeter. It is to be understood that the metal bar stock used is inherently flexible like a spring or convertible to a spring condition by suitable treatment as, for example, tempering of carbon steel bar stock.

According to a further aspect of the invention there is provided a method of producing an improved vapor seal for a vertical cylindrical liquid storage tank of imprecise circularity having a circular floating roof with an outer cylindrical vertical wall of smaller diameter than the tank thereby defining a vapor space between the roof wall and the tank wall which requires a vapor seal, comprising substantially axially compressing one or more coil spring segments, which when not under axial tension or compression have a width at least slightly larger than the width of the vapor space, and then securing the coil spring segments under such compression; transporting the compressed coil spring segments to the tank erection site; releasing the compression on the coil spring segments at the erection site; horizontally positioning the one or more coil spring segments in line, completely around the roof perimeter, in a pouch between the tank wall and the roof wall with said pouch being formed at the site from a vapor resistant flexible strip of material having parallel longitudinal edges; and attaching the strip edges to the roof completely around the roof perimeter. The spring segments can be made of metal, such as spring steel, or carbon fiber containing flexible rods.

The described methods can include attaching the coil spring to the roof wall when the strip edges are joined to the roof in a spaced apart arrangement which permits the spring to be so attached. Alternatively, the methods can include attaching the coil spring to the outer surface of a vertical circular plate and suspending the plate in the pouch.

The described seal is relatively easy to fabricate and install and thus should be comparatively inexpensive. Forming the spring at the site from bar stock should reduce shipping and packaging expenses. It also provides a way to custom form the spring for the size of the tank and the width of the vapor space clearance. In the event it is undesirable to form the spring at the site, the spring can be produced at a manufacturing center, compressed as much a conveniently possible and then shipped in the compressed state thereby taking up much less space.

By enclosing the spring with the flexible strip a vapor barrier is inexpensively formed. It also is easy to repair since the spring can be reused when the strip is replaced.

BRIEF DESCRIPTION OF THE DRAWINGS

FIG. 1 is an isometric view of the vapor space of a floating roof tank having a seal according to the invention mounted therein;

FIG. 2 is a plan view of the seal shown in FIG. 1;

FIG. 3 is a plan view of the coil spring used in the seal shown in FIGS. 1 and 2;

FIG. 4 is a sectional view through the seal of FIGS. 1 to 3;

FIG. 5 is an end view of a seal according to the invention in which the coil spring is higher than it is wide and the spring is attached to the roof side wall.

DETAILED DESCRIPTION OF THE DRAWINGS

Figure 6:
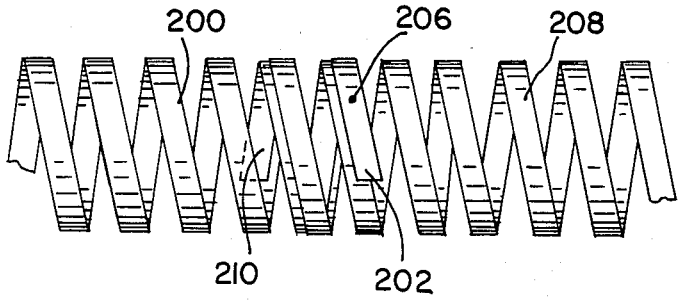
FIG. 6 illustrates the interengagement of two spring ends.

To the extent it is reasonable and practical the same numbers will be used to identify the same or similar elements in the various views of the drawings.

The floating roof 10 shown in FIG. 1 is located inside of vertical cylindrical circular wall 12 of a liquid storage tank. The floating roof 10 has a top plate 14 and a bottom plate 16 to which circular end wall 18 is joined, such as by welding. The floating roof vertical wall 18 is circular and cylindrical and spaced inwardly from tank wall 12, thereby defining a vapor space between the walls.

Coil spring 20 shown in FIGS. 1 to 4 is mounted horizontally on vertical cylindrical plate 24 by spaced apart clips 22. The clips 22 overlay the back portion of spaced apart coils of the spring 20 and are secured in place by bolts 26.

Vapor resistant flexible strip 30 having opposing parallel edges 32 and 34 is wrapped around plate 24 on which spring 20 is mounted. The parallel edge 32 is placed against the top back edge of plate 24 and the parallel edge 34 is placed against the top front edge of plate 24. Then a metal strip 36 is positioned over edge 34 and the resulting composite is connected to the top part of roof wall 18 by bolts 38. The flexible vapor resistant strip 30 fits loosely around spring 20 yet the described arrangement effectively prevents vapor from escaping from the vapor space beneath the seal.

The diameter of spring 20 is made slightly larger than the width of the vapor space so that the flexible strip 30 is always pressed into sealing engagement with tank wall 12.

Instead of mounting spring 20 on a plate 24 as described above, it is also feasible to mount the spring as shown in FIG. 5 in which the coil spring 40 is mounted by clips 22 directly to roof wall 18. With such an arrangement the edge 32 of strip 30 is joined to the lower part of roof wall 18 with edge 34 mounted to the top edge of the roof side wall. The spring 40 shown in FIG. 5 is more or less elliptical with the height of the coils greater than their width. When the spring is compressed in the vapor space, the vertical side portions of the coils flatten and thus have a greater area in contact with the strip 30 and side wall 18. Such a structure serves to place a greater surface area of strip 30 into contact with tank wall 12 thereby promoting sealing.

FIG. 6 illustrates one way in which the interengagement of two spring ends can be effected. As shown in this drawing, the end 210 of coil spring 208 is inserted into the end 210 of coil spring 200. If desired, a rivet 206 or other fastener can be used to join together an adjacent coil of each spring. In this way the ends of a single spring, or the ends of two spring segments, can be interengaged.

The foregoing detailed description has been given for clearness of understanding only, and no unnecessary limitations should be understood therefrom as modifications will be obvious to those skilled in the art.

What is claimed is:

1. In a vertical cylindrical liquid storage tank of imprecise circularity having a circular floating roof with an outer cylindrical vertical wall of smaller diameter than the tank thereby defining a vapor space between the roof wall and the tank wall, the improvement comprising:

a resilient seal located in and spanning the vapor space between the tank wall and the roof wall;

the seal including a vapor resistant flexible longitudinal strip of material having parallel longitudinal edges attached to the roof defining a horizontal pouch extending around the roof periphery; and a horizontal coil spring, located in the pouch for the length of the vapor space, with one side of the spring in contact with, and joined to, the roof wall by spaced apart clips.

2. In a vertical cylindrical liquid storage tank of imprecise circularity having a circular floating roof with an outer cylindrical vertical wall of smaller diameter than the tank thereby defining a vapor space between the roof wall and the tank wall, the improvement comprising:

a resilient seal located in and spanning the vapor space between the tank wall and the roof wall;

the seal including a vertical metal plate having an upper edge, and a vapor resistant flexible longitudinal strip of material having parallel longitudinal edges brought together with one strip edge in contact with each side of the plate upper edge thereby defining a horizontal pouch extending around the roof periphery;

means attaching the strip upper edges and the plate upper edge to the roof near the wall upper edge to suspend the seal from the roof with the plate suspended in the pouch; and a horizontal coil spring located in the pouch for the length of the vapor space with the coil spring connected to the outer surface of the metal plate.

3. An improved seal according to claim 2 in which the spring is attached to the plate by clips.

* * * * *